United States Patent [19]

Stephan

[11] 4,420,893

[45] Dec. 20, 1983

[54] SHOE COMPRISING A SYSTEM FOR SUPPLYING AIR TO THE INTERIOR OF THE SHOE

[75] Inventor: Walter Stephan, Ried im Innkreis, Austria

[73] Assignee: Fischer Gesellschaft M.B.H., Ried im Innkreis, Austria

[21] Appl. No.: 320,076

[22] Filed: Nov. 10, 1981 (Under 37 CFR 1.47)

[51] Int. Cl.[3] ..... A43B 7/06; A43B 7/08

[52] U.S. Cl. ..... 36/3 R; 36/29; 36/117; 36/120

[58] Field of Search ..... 36/3 R, 3 B, 29, 117, 36/120

[56] References Cited

U.S. PATENT DOCUMENTS 3,029,530 4/1962 Eaton ..... 36/3 R

FOREIGN PATENT DOCUMENTS 325458 10/1975 Austria .

22043 of 1907 United Kingdom ..... 36/3 R 357391 9/1931 United Kingdom ..... 36/3 R

*Primary Examiner*—Louis Rimrodt

*Assistant Examiner*—Steven W. Meyers

*Attorney, Agent, or Firm*—Fleit, Jacobson, Cohn & Price

[57] ABSTRACT

A system for supplying air to the interior of a shoe, particularly of a skiing boot for Alpine skiing is disclosed. The shoe or skiing boot comprises a shell and a gaiter, which is pivoted to the shell and pivotally movable in the longitudinal direction of the shoe. An air-handling device is mounted on the shell of the shoe and is connected to actuating means. The latter is also connected to the gaiter and during a forward and rearward pivotal movement of the gaiter move up and down to impart a pumping motion to the air-handling device so that air is pumped into the interior of the shoe. The air inlet is preferably disposed near the sole of the shoe.

4 Claims, 7 Drawing Figures

SHOE COMPRISING A SYSTEM FOR SUPPLYING AIR TO THE INTERIOR OF THE SHOE

BACKGROUND OF THE INVENTION

Figure 1:
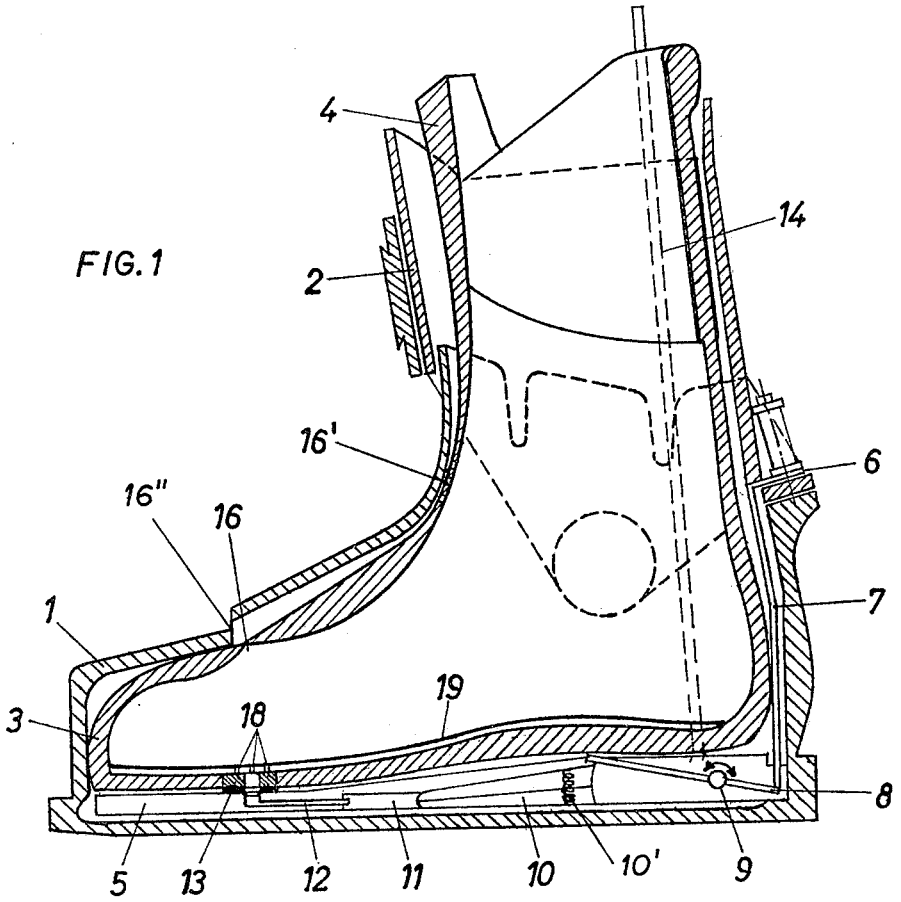

A system for supplying air to the interior of a shoe, which comprises a shell and a gaiter, which is pivoted to the shell and pivotally movable in the longitudinal direction of the shoe is disclosed. An air-handling device is mounted on the shell of the shoe and is connected to actuating means which are operable to cause the air-handling device to pump air. The actuating means are connected to the gaiter and are moved by the pivotal movement of the gaiter.

This invention relates to a system for supplying air to the interior of a shoe or boot, particularly of a skiing boot for Alphine skiing, which shoe comprises a shell and a separate gaiter, which is pivoted or hinged to the shell. An air-handling device is mounted on the shell of the shoe and is operable by the gaiter as the latter is pivotally moved relative to the shell of the shoe.

In the early times of skiing, the skiing boot had only clothing functions and was intended to improve the ability of human beings to withstand changing climatic environmental conditions, particularly to shield against low temperatures and moisture. It must also be borne in mind that the generation of heat and the production of sweat by a human being changes continually in dependence on day-to-day changes of the climate and weather and in dependence on the nature of the activity performed and the effort required. A shoe will not give its wearer a comfortable feeling unless it can balance the external and internal influences in such a manner that a temperature of 28° to 34° C. and a relative humidity of 50 to 70% are maintained at the foot. As the design of the shoe and the materials used to make it were formerly selected in view of these requirements, the boots for Alpine skiing consisted mainly of leather, which is a natural product and provides for an adaptation to the shape of the foot and to the above-mentioned conditions. As the skiing techniques were improved, the functions which were significant for the skiing technique became more important in the design of skiing boots. The desire for an improved lateral stability and the use of different binding systems have resulted in the use of different materials, which involve different manufacturing technologies.

In one or two operations, the shell and the gaiter are made from polymers by means of an injection molding machine and the two parts are then joined by suitable methods (riveting). An inner shoe is provided for adaptation to the foot. The interior padding sometimes contains a flowable material, or a good fit is ensured by adaptable systems, which are connected to hydraulic cushions. The adaptable system which has met with the widest acceptance is the foamed inner shoe, which comprises a material that is tolerated by the skin (leather, Helanca and the like) and coated with plastic material, which is provided with a layer of foamed plastic material, which consists mainly of integral polyurethane foam.

Only the layer which is close to the skin consists of leather or the like. The externally disposed plastic materials are moisture-impermeable and highly heat-insulating so that they inhibit a removal of moisture and heat from the layers that are close to the skin. As a result, the climate in the shoe changes quickly. As the moisture content increases, the heat insulation decreases and the skiier has the distinct feeling of moisture and cold.

In this connection it has already been proposed to provide the shoe at its instep portion or sole with bellows, which are operated by the motions performed by the foot in the shoe during walking and which by means of hoses deliver fresh air into the shoe (German Patent Specification No. 531,997; German Early Disclosure No. 1,679,592). Such devides can only be used if the shoe is larger than would otherwise be required so that the foot can move in the shoe so as to operate the bellows. That concept cannot be used with skiing boots, where an exact, tight and immovable fit of the shoe on the foot is most important.

In French Patent Specification No. 1,598,123 it has been suggested to provide in the heel of the shoe a piston pump having an axis which extends in the longitudinal direction of the shoe. The piston is reciprocated by the movements of the shoe to various inclined positions during walking. Such pumps have only a low capacity and the motion of the piston can easily be obstructed by an ingress of dirt so that the pump will soon be inoperative. Besides, such pumps cannot be used in skiing boots because the skiing boot is rigidly connected to the ski so that it cannot change its position so as to reciprocate the pump piston.

U.S. Pat. No. 3,273,264 discloses a battery-operated fan, which is provided in the heel of the boot. That concept is expensive and the fan is unreliable in most cases and has only a low capacity. Besides, the life of a battery set is much too short for the use of such fans in skiing boots and sports shoes.

Austrian Patent Specification No. 325,458 discloses an air-supply system comprising pumping means which consist of a bellows provided adjacent to the instep portion of the shoe. But the displacement which can be imparted to said bellows at the instep portion is very small so that said device had apparently only a very low air-handling capacity. Besides, the bellows was not operative unless the shoe or its parts consisted of very hard material, such as metal or stiff plastic material. Owing to requirement for skiing boots having very stiff parts, the subject matter of the last-mentioned Austrian patent specification cannot be used in conventional skiing boots.

U.S. Pat. No. 2,716,293 discloses also a shoe which is supplied with air by an air-handling device provided at the instep portion of the shoe. A forward movement of the lower leg will always involve a lowering of the ankle joint; these two movements result in mutually opposite changes of the volume of the bellows, which constitutes the air-handling device and is filled with a porous spongy mass. By said movements, the bellows is compressed adjacent to the lower leg and permitted to expand adjacent to the angle joint so that an undefined, very small volume of air is delivered. Besides, in that shoe the air is sucked from the interior of the shoe and blown off to the outside. Owing to the bone structure of the foot, that shoe is not capable of handling air at a rate which is sufficient for maintaining a pleasing climate at the foot.

U.S. Pat. No. 3,029,530 discloses a shoe which has a bellows-like, hollow heel. Air is supplied to the interior of the shoe as the foot performs a walking motion, by which the heel is compressed and released in alternation. This obviously results in a change of the height of the wedge-shaped heel so that the position of the heel of the foot relative to the supporting surface is changed.

Such shoes cannot be used as skiing boots because the skiing boot is rigidly held in the binding so that the heel of the boot cannot and must not be deformed. In the system according to the invention the rigid hollow heel is only a housing, which contains the parts of the air-handling device, which are moved by the lower leg, and the air conduits.

U.S. Pat. No. 3,180,039 discloses a hollow insole having a heel portion which constitutes a bellows whereas the remaining portion of the sole is formed with air exit holes. Such an insole may be useful in shoes for walking and in training shoes, in which the foot has a relatively large freedom of movement so that the foot can directly operate the bellows in the shoe. But such a vertical movement of the foot in a skiing boots prohibited by the safety standards which are in force. Besides, such insole permits only a circulation of air in the shoe rather than a supply of fresh air.

The air-supplying devices described in the two U.S. patents mentioned last are inconsistent with the requirements to be met by skiing boots from the orthopedic aspect.

In order to avoid all the above-mentioned disadvantages of the known shoes it is proposed by the invention that a system of the kind described first hereinbefore should be provided with actuating means, which act on the air-handling device and are connected to the gaiter. The use of such actuating means provides for a greater latitude as regards the selection of the location of the actual air-handling means proper.

Further features of the invention will now be explained with reference to the drawings, in which three illustrative embodiments and associated details of the system according to the invention are shown.

Figure 3:
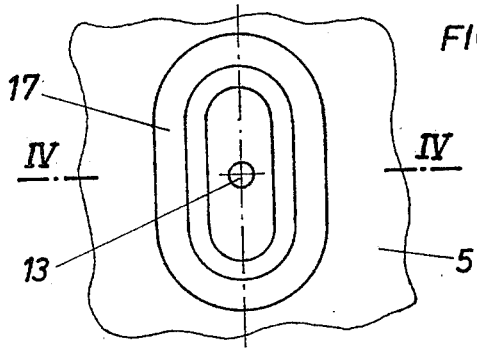
Figure 2:
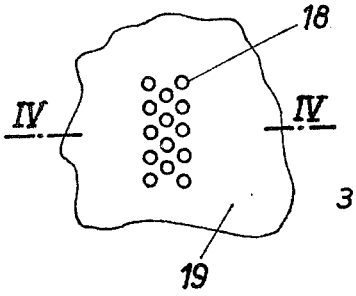
Figure 4:
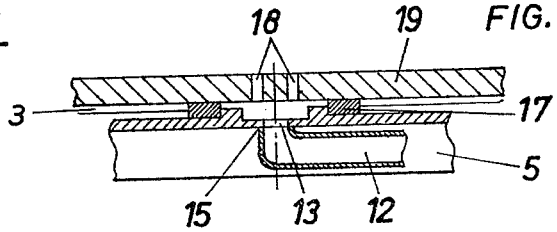

FIG. 1 is a sectional view showing a skiing boot according to a first embodiment, FIGS. 2 and 3 are top plan views respectively showing the air exit openings and the air inlet opening disposed below the air inlet opening, FIG. 4 is a sectional view taken on line IV—IV in FIGS. 2 and 3, FIG. 5 a sectional view showing a skiing boot according to a third embodiment, FIG. 6 a top plan view showing an air exit slot of the shoe of FIG. 5 and FIG. 7 a sectional view taken on line VII—VII in FIG. 6.

FIG. 1 is a sectional view showing a skiing boot, which consists of a plurality of plastic material parts, specifically a shell 1 consisting of stiff material, a gaiter 2, a tongue 4 and an inner shoe 3, which consists of foamed polyurethane. The air-supplying system comprises a wedge-shaped bellows 10, which is disposed under the wedge-shaped insert 5 between the inner shoe 3 and the shell 1 of the skiing boot, near the most steeply sloping portion of the wedge-shaped insert, and conduits 12, which extend from the bellows 10 to sealing surfaces 15, which adjoin nozzle 13. Air intake conduits 14 are provided for a supply of dry air from within the trousers adjacent to the lower leg to the bellows 10.

The bellows is mechanically operated by the movement of the lower leg, which is embraced by the gaiter 2. The latter is connected to the bellows 10 by a coupling element 6, a tie rod 7 and a transmitting lever 8, which is supported on the wedge-shaped insert 5 by a pivot 9 and serves also as a plate for applying pressure to the bellows.

The bellows 10 is wedge-shaped and consists of flexible air-tight material (plastic material) and two stiffened walls, namely, the bottom plate and the pressure-applying plate, which are urged apart by a spring 10'. The restoring force of the bellows may be assisted by the spring and causes the bellows to suck air through a check valve, not shown. The stiff walls of the bellows will thus be moved apart when the wearer of the shoe urges his or her lower leg against the rear portion of the gaiter in order to pull the ski forward. As a result, the coupling element 6, the rod 7 and the transmitting lever 8 will be relaxed.

During the opposite movement, by which the lower leg is forwardly inclined, the gaiter 2 is pivotally moved forward so that the coupling element 6 performs a vertical movement, which is transmitted by the rod 7 to one end of the transmitting lever 8. The location of the pivot 9 is so selected that the transmitting lever increases the vertical displacement. The transmitting lever 8 is connected to or integral with the pressure-applying plate of the bellows.

Now the above-mentioned check valve is closed and the outlet valve 11 connected to the conduits 12 is opened under the superatmospheric pressure then existing within the bellows. As a result, the air flows through the conduits 12 to the nozzle 13 and through the latter enters the interior of the shoe. The nozzle 13 may be designed in various forms and is in sealing contact with the wedge-shaped insert 5. The system consisting of the nozzle 13 and the air exit openings of the wedge-shaped insert is suitably designed as shown in FIG. 2. The nozzle 13 is desirably embedded in the walls of the inner shoe during the manufacture of the latter.

FIG. 2 shows the exit openings 18 formed in the sole 19 of the inner shoe. FIG. 3 shows the air inlet opening in the wedge-shaped insert 5. That air inlet opening is surrounded by a sealing element 17, which is engaged by the sole 19 from above (see FIG. 4).

The air which has been supplied into the interior of the shoe can flow around the foot so that the air will absorb moisture that has been formed in the shoe. The air then flows through openings 16, 16' of the inner shoe 3 into the shell of the shoe and can escape from said shell through an opening 16'' or upwardly out of the shoe.

Figure 5:
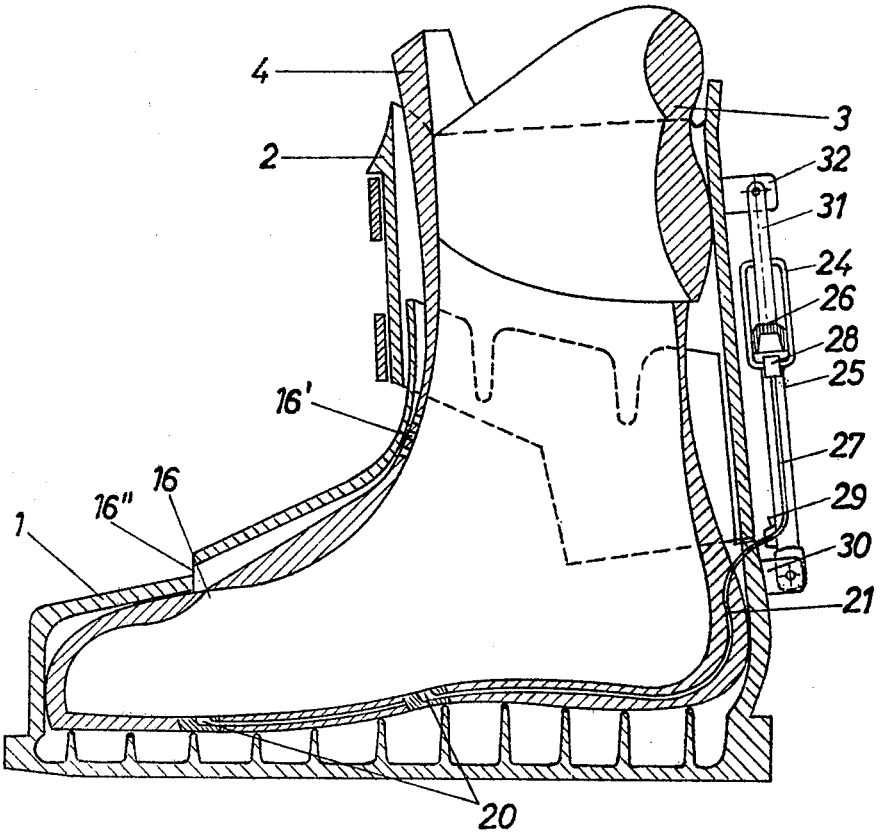
Figure 6:
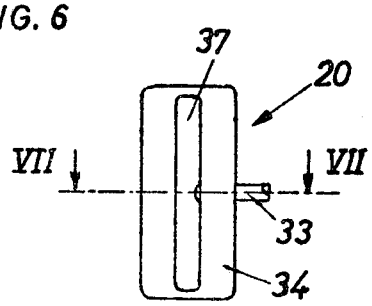
Figure 7:
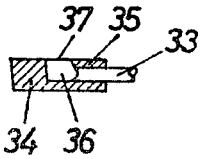

Another embodiment of the system according to the invention is shown in FIGS. 5 to 7. The shoe itself is designed entirely like that of FIG. 1, except that the bellows 10 has been replaced by a piston pump 24. The latter consists of a cylinder member 25 and a piston 26. The cylinder member 25 consists of a rod, which has an enlarged top portion forming a pump cylinder. A passage 27 extends through said top portion from the cylinder and incorporates a diagrammatically indicated check valve 28 and terminates short of the lower end of the rod in a fitting 29, from which a conduit 21 extends, which is connected by branch conduits to respective nozzles 20. The lower end of the cylinder member 25 is pivoted to a bracket 30 carried by the shell of the skiing boot adjacent to the heel of the shoe.

The nozzles have, e.g., the form shown in FIGS. 6 and 7. Each of them consists of an approximately troughlike member 34, which has an aperture 35, in which the end portion of the conduit 33 is frictionally fitted or joined by an adhesive. The aperture 35 opens into the interior 36 of the nozzle. The exit opening 37 leading from said interior is much larger than the crosssection of the conduits 33. That exit opening faces upwardly toward the interior of the shoe.

The conduits 33 and the nozzles 20 are desirably embedded in the walls of the inner shoe during the manufacture thereof.

The piston 26 may be designed like the piston of a bicycle pump and consists of a disc of flexible material, such as leather, rubber or the like, and has a peripheral annular lip, which during the discharge stroke is in sealing contact with the cylinder wall whereas during the opposite stroke the lip disengages the cylinder wall so that air can enter the cylinder. In this arrangement the lip piston 26 replaces the second check valve.

The piston rod 31 is guided in a constricted opening at the top end of the cylinder and is pivoted to a bracket 32 carried by the gaiter 2 of the boot. The gaiter will be pivotally moved relative to the shell of the skiing boot during any movement of the lower leg so that the piston 26 will be moved up and down to ensure a supply of fresh air into the interior of the boot.

What is claimed is:

1. In a ski boot of the type having a shell, a gaiter which is pivotally mounted on the shell and movable in the longitudinal direction of the boot, an inner shoe and a wedge-shaped hollow section below the outer portion of the sole of the inner shoe, a system for supplying air to the interior of the boot comprising:

an air handling device mounted on the shell of the boot;

an actuating means operatively connected at one end to the air handling device and connected at the other end to the rear side of the gaiter directly above the heel;

one or more nozzles which are embedded in the walls of the inner shoe;

one or more conduits for air passage which are connected at one end to the air handling device and at the other end to the nozzle;

air passage openings in the top of the inner shoe on the side remote from the actuating means; and openings in the shell of the boot on the side remote from the actuating means for air exhaust to the outside of the boot.

2. A system according to claim 1, wherein the air handling device comprises a bellows located in the instep area of said hollow section of the boot and which is provided with a double-armed lever on the side remote from the outer portion of the sole of said inner shoe for applying pressure to the bellows, a coupling element attached to said gaiter, and a tie rod connected at one end to the coupling element and at the other end to the side of said double-armed lever remote from the bellows as a means for actuating the bellows.

3. A system according to claim 1, wherein the air handling device comprises a piston pump, one end of said pump being connected to the heel portion of the shell of the boot and the opposite end of said pump being articulatedly connected to the rear side of the gaiter of the boot.

4. A system according to claim 3 wherein a rearwardly protruding bracket is provided on said heel portion of the shell and another rearwardly protruding bracket is provided on said rear side of the gaiter for articulatedly connecting each end of said piston pump.

* * * * *